US009822544B2

(12) United States Patent
Stevens et al.

(10) Patent No.: US 9,822,544 B2
(45) Date of Patent: Nov. 21, 2017

(54) MONOPOLE TOWER REINFORCEMENT SYSTEM

(71) Applicant: Infinigy Solutions, LLC, Albany, NY (US)

(72) Inventors: John S. Stevens, Rexford, NY (US); Andrew J. DeSantis, III, Malta, NY (US); Joseph R. Johnston, Malta, NY (US); Merritt P Bell, Wells, VT (US)

(73) Assignee: Infinigy Solutions, LLC, Albany, NY (US)

( * ) Notice: Subject to any disclaimer, the term of this patent is extended or adjusted under 35 U.S.C. 154(b) by 0 days.

(21) Appl. No.: 14/836,829

(22) Filed: Aug. 26, 2015

(65) Prior Publication Data

US 2017/0058548 A1 Mar. 2, 2017

(51) Int. Cl.

| | |
|---|---|
| ***E04H 12/16*** | (2006.01) |
| ***E04H 12/20*** | (2006.01) |
| ***E04H 12/22*** | (2006.01) |
| ***E04H 12/34*** | (2006.01) |
| ***H01Q 1/12*** | (2006.01) |

(52) U.S. Cl.

CPC ..... *E04H 12/20* (2013.01); *E04H 12/2292* (2013.01); *E04H 12/347* (2013.01); *H01Q 1/12* (2013.01)

(58) Field of Classification Search

CPC ... E04H 12/20; E04C 3/30; E04C 3/32; E04C 3/34; E04C 5/18; E04C 5/0609; E04G 23/0225; E04G 23/0218

See application file for complete search history.

(56) References Cited

U.S. PATENT DOCUMENTS 578,524 A * 3/1897 Reid ..... E04H 12/20 52/148
915,305 A * 3/1909 Newhall ..... E04H 12/20 52/148
919,771 A * 4/1909 Roberts et al. ..... E04H 12/08 52/152
1,902,945 A * 3/1933 Blackburn ..... F16G 11/06 52/147
2,980,376 A * 4/1961 Westerfield ..... E04H 12/20 248/536
3,378,981 A * 4/1968 Horne ..... E04C 5/18 52/677
5,133,164 A * 7/1992 Legler ..... E04H 12/2261 52/165

(Continued)

FOREIGN PATENT DOCUMENTS

WO WO 03076737 A1 * 9/2003 ..... E04C 3/32

*Primary Examiner* — Christine T Cajilig
(74) *Attorney, Agent, or Firm* — Lee Palmateer Law Office LLC; Lee Palmateer

(57) ABSTRACT

An upright reinforcing rod connected to the ground with a mechanical anchor and to the monopole tower with a bracket at a top elevation. The rod is stabilized laterally by being disposed through vertically oriented openings in lateral supports at intermediate elevations. There may be a clearance fit between the rod and lateral supports. The rod may be inserted sideways into the supports. The connection between rod and support may be boltless and simple. The support may comprise spring loaded latch fingers for capturing the rod. The mechanical anchor and intermediate supports provide improved installation methods.

29 Claims, 14 Drawing Sheets

(56) References Cited

U.S. PATENT DOCUMENTS

| | | | | |
|---|---|---|---|---|
| 6,212,848 | B1 * | 4/2001 | Cooper | E04C 5/168 404/135 |
| 6,694,698 | B2 * | 2/2004 | Ryan | E04C 3/30 52/741.1 |
| 6,901,717 | B2 * | 6/2005 | Brunozzi | E04H 12/2292 52/294 |
| 6,915,618 | B2 * | 7/2005 | Payne | E04H 12/2292 52/849 |
| 7,253,786 | B1 | 8/2007 | Logozzo | |
| 8,191,332 | B1 * | 6/2012 | Semaan | E02D 5/60 174/45 R |
| 8,528,298 | B2 | 9/2013 | Semaan | |
| 2004/0020158 | A1 * | 2/2004 | Kopshever, Sr. | E04C 3/30 52/835 |
| 2006/0024148 | A1 * | 2/2006 | Wei | F16B 21/02 411/348 |
| 2014/0208683 | A1 | 7/2014 | Soucy | |
| 2015/0184415 | A1 * | 7/2015 | Bushore | E02D 27/42 52/831 |

* cited by examiner

MONOPOLE TOWER REINFORCEMENT SYSTEM

TECHNICAL FIELD

The present invention relates to monopole tower reinforcement apparatus and methods.

BACKGROUND OF THE INVENTION

Monopole towers are used to support antenna arrays for wireless telecommunication systems. Monopole towers typically comprise a monopole, which is a hollow tubular structures, made of metal, with polygonal or circular cross section, relatively wider at the base, and tapering with elevation. Such towers typically further comprise structural enhancement attached to the bottom of the monopole, such as base plates. The towers are designed to support specified design loads. However, need may arise after the initial tower installation to exceed specified design loads. Thus it may become necessary to reinforce an existing tower to increase its load carrying capacity, such as to increase capacity to carry combined axial, moment and shear loading.

Antennae impart vertical compressive loads and significant bending moments on the tower. Wind imparts cyclic lateral loads and bending moments, which induces sway causing additional secondary bending moments. Reinforcement means must accommodate these loads.

One existing way to reinforce monopoles is to attach reinforcing rods to the sides of the tower. In such systems, the rods may be embedded in the foundation and tightly attached to the tower using mounting brackets at multiple elevations. An example of a mounting bracket comprises an angle iron bolted to the side of the tower with U-bolts that fasten the rods to the angle iron. Rods spaced a distance outboard of the tower increase the effective cross sectional moment of inertia and bending load capacity relative to the unreinforced tower. To transmit rod loads directly to the ground, some systems embed the rods directly in the tower foundation.

When the entire system is experiencing bending loads, such as under lateral wind loads, individual reinforcing rods on one side of the tower may be in tension while rods on the opposite side may be in compression. Loads in a reinforcing rod may alternate cyclically from tension to compression when the tower experiences back and forth sway in wind.

Existing systems rely on fixed attachment of the reinforcing bar rods at intermediate brackets that are spaced apart at vertical intervals. Fixed intermediate attachment affects the mechanical properties and mechanical behavior of the entire system and individual components thereof, including the pole, the brackets and the rods. The intermediate brackets experience significant loads. In addition, substantial assembly work is involved in making each intermediate connection separately, including mounting each bracket to the pole and mounting each bracket to the reinforcing rod. Typically, existing systems also embed reinforcing rods in the foundation by boring holes in the foundation, inserting rods in the holes, and then filling the remaining space in the holes with adhesive or grout to form the joint between the foundation and rod. This embedding procedure and resulting joint have undesirable qualities, such as undesirable qualities under cyclic loading.

There is a need for a monopole tower reinforcing system with a different type of intermediate support that simplifies assembly, that provides lateral spacing and stability to the reinforcing rods, and that may reduce support loads and provide axial freedom of deflection to the rod. There is also a need for a system that does not rely on embedded reinforcing rods in the foundation and using adhesives or grout to form the joint between the rods and foundation.

The present invention fills those and other needs.

SUMMARY OF THE INVENTION

In a first aspect, the present invention provides a monopole tower reinforcement apparatus comprising an upwardly extending elongated reinforcing member connected to the ground outboard of the monopole. The reinforcing member is attached to the monopole at an upper connection above the ground. A standoff is attached to the tower above the ground and below said upper connection. The standoff may comprise an open end for receiving sideways insertion of said reinforcing member and an upwardly oriented opening spaced a distance laterally outward from the tower. The reinforcing member is disposed through said upwardly oriented opening so as to be deflection-limited laterally by the standoff. The connection to the ground may comprise a mechanical anchor and may comprise a connection to the foundation of the monopole.

In a second aspect, the present invention provides a monopole tower reinforcement apparatus comprising an upwardly extending elongated reinforcing member connected to the ground outboard of the monopole, said reinforcing member attached to the monopole at an upper connection at a height above the ground. A standoff may be attached to the tower at a height above the ground and below said upper connection, said standoff comprising an upwardly oriented opening spaced a distance laterally outward from the tower. Said reinforcing member may be disposed through said upwardly oriented opening so as to be deflection-limited laterally and unbound vertically by the standoff.

In a third aspect, the present invention provides a method for reinforcing a monopole tower installed on a foundation comprising the steps of anchoring an elongated reinforcing member to the foundation; identifying an upper elevation and intermediate elevation wherein the intermediate elevation is lower than the upper elevation; tightly connecting said elongated reinforcing member to the tower at said upper elevation; providing a standoff having an upwardly oriented opening for receiving the reinforcing member; and attaching the standoff to the tower and disposing the reinforcing member through said opening in the standoff at said intermediate elevation so as to provide lateral stability to the reinforcing member and freedom of vertical displacement between the reinforcing member and standoff.

In a fourth aspect, the present invention provides a method for reinforcing a monopole tower installed on a foundation comprising the steps of anchoring an elongated reinforcing member to the foundation; identifying an upper elevation and intermediate elevation wherein the intermediate elevation is lower than the upper elevation; tightly connecting said elongated reinforcing member to the tower at said upper elevation; providing a standoff having an opening for receiving sideways insertion of the reinforcing member; inserting a reinforcing member sideways through said opening in the standoff; and attaching the standoff to the tower at said intermediate elevation.

In a fifth aspect, the present invention provides a standoff for securing an elongated reinforcing member to a monopole tower comprising a body having a proximal end and a distal end; said proximal end adapted for attachment to the side of the tower; said body having a first upwardly oriented opening for receiving an upright reinforcing member; and said distal end having a transverse opening in communication with said first opening so that a reinforcing member may be received sideways through said transverse opening and then disposed upright in the first opening by twisting the standoff.

In a sixth aspect, the present invention provides a standoff for securing an elongated reinforcing member to a monopole tower comprising a body comprising a proximal portion adapted for attachment to the side of the tower and a distal portion adapted for receiving the reinforcing member. Said distal portion comprises a first extension extending distally and a second extension extending distally. Said first and second extensions define an upwardly oriented opening through which the elongated reinforcing member may be disposed upright. Said first and second extensions are spaced apart vertically so as to define a transverse space between them so that the elongated reinforcing member may be disposed upright in the upwardly oriented opening by a sideways insertion between the extensions and a twisting of the standoff.

In a seventh aspect, the present invention provides a standoff for securing an elongated reinforcing member to a monopole tower comprising a body having a proximal end and a distal end; said proximal end adapted for attachment to the side of the tower; and said distal end having a first upwardly oriented opening for receiving sideways insertion of an upright reinforcing member.

BRIEF DESCRIPTION OF THE DRAWINGS

The subject matter that is regarded as the invention is particularly pointed out and distinctly claimed in the concluding portion of the specification. The invention, however, may be best understood by reference to the following detailed description of various embodiments and the accompanying drawings in which:

DETAILED DESCRIPTION OF THE INVENTION

Figure 1:
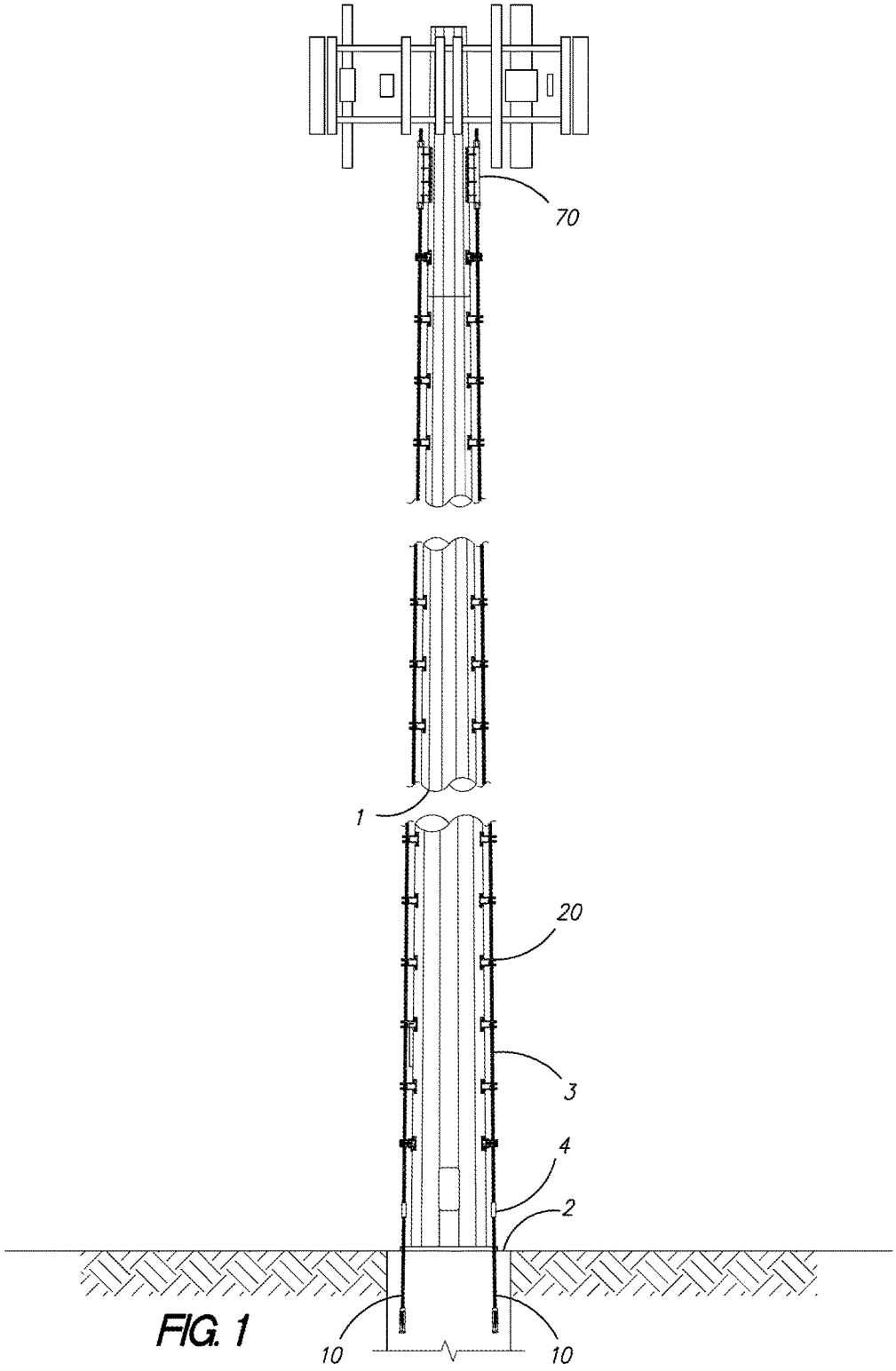
FIG. 1 is an elevation view of a tower reinforcement system in accordance with the present invention.

With reference to FIG. 1, a typical monopole tower 1 is shown in assembly with one embodiment of a reinforcement system of the present invention. Anchor 10 is anchored to foundation 2. The anchor extends above the foundation and is coupled to elongated reinforcing member 3 with a coupling 4. Reinforcing member 3 is connected to tower 1 at at least one elevation above the anchor. The uppermost connection comprises a termination bracket 70. Reinforcing member 3 may be connected to tower 1 with one or more standoffs 20 at one or a plurality of intermediate elevations above anchor 10 and below termination bracket 70.

The reinforcement system may comprise multiple reinforcing members spaced around the tower. They may be equally spaced, such as three members spaced 120° apart from each other around the tower as in FIG. 2C.

Connection of an upwardly extending elongated reinforcing member to the ground outboard of the monopole may comprise a connection that goes to or through the structural enhancements at the base of the monopole, such as to or through a base plate, and may comprise a connection that is an outboard distance away from such base structural enhancements. References to outboard of the monopole comprise outboard of the hollow tubular walls of the monopole.

The term "standoff" herein is a device for providing lateral spacing between a monopole tower and an elongated reinforcing member and providing lateral stabilization of the said reinforcing member. Preferred embodiments of the present invention may comprise "boltless" standoffs, meaning that the structural elements of the standoff forming the connection with the reinforcing member, whether a loose or tight connection, do not comprise threaded members. Preferred embodiments of the present invention may comprise "insertion" standoffs, meaning that the method of connection between the standoff and reinforcing member comprises sideways insertion of the member into an opening in the standoff.

In the description of the standoff bodies 21 and 41 herein, "distal" and "proximal" generally relate to proximity to the monopole when operatively assemble with the monopole. In the description of lock pin 52 and push pin 100, "distal" and "proximal" relate to proximity to the head of those parts.

In the embodiment of FIG. 1, reinforcing member 3 may be a reinforcing rod and may have threaded ends for coupling with other threaded parts, such as threaded couplings or nuts. Couplings 4 may be threaded couplings. Reinforcing rods may be threaded over their entire length. Reinforcing members may also comprise segments that are coupled together endwise. Reinforcing members may comprise multiple segments coupled together endwise with multiple vertically spaced apart couplings.

Figure 8A:
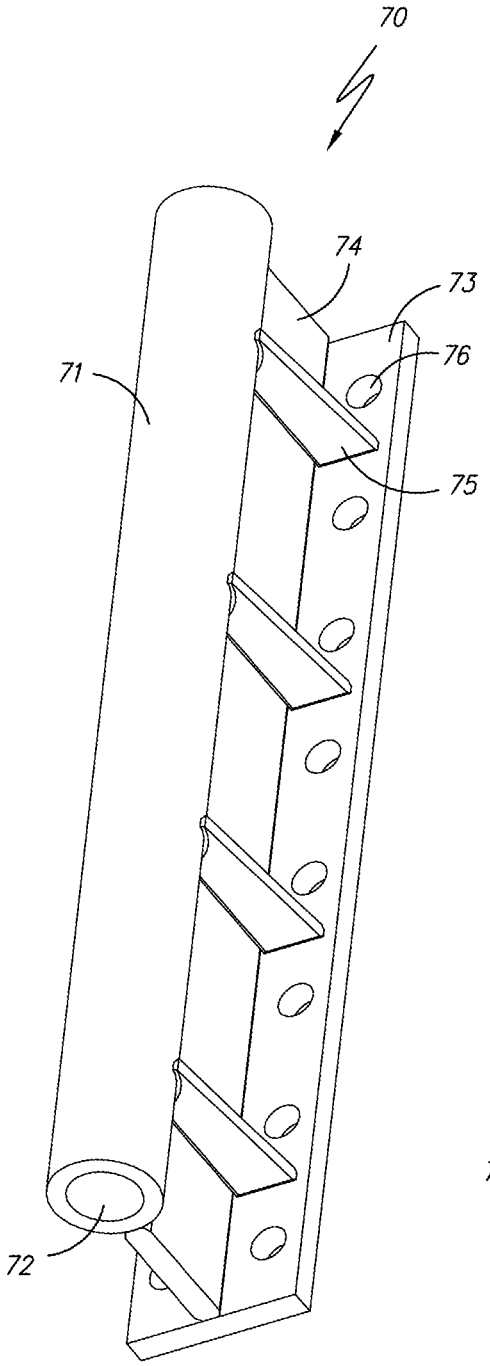
FIG. 8A is a perspective view of a termination bracket of the present invention.
Figure 8B:
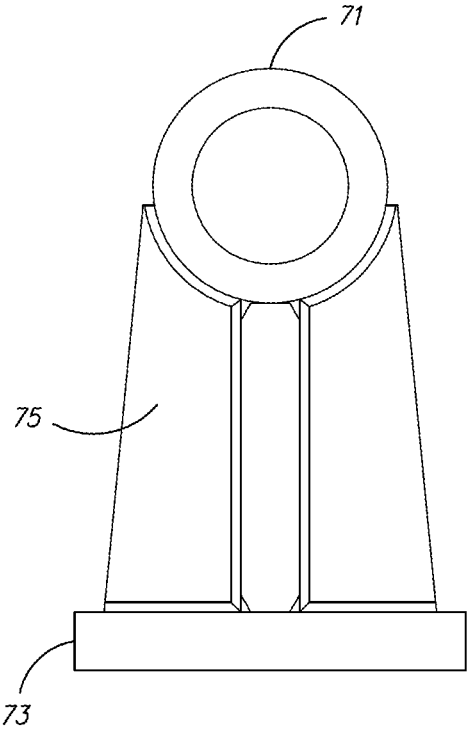
FIG. 8B is an end view of the termination bracket of FIG. 8A.

With reference to FIGS. 8A and 8B, termination bracket 70 comprises cylinder 71 with center hole 72, flange 73, web 74 and ribs 75. The web and ribs connect the flange and cylinder together. Flange 73 has holes 76 for receiving fasteners to fasten the bracket to the monopole. Center hole 72 is for receiving reinforcing rod 3.

Figure 9A:
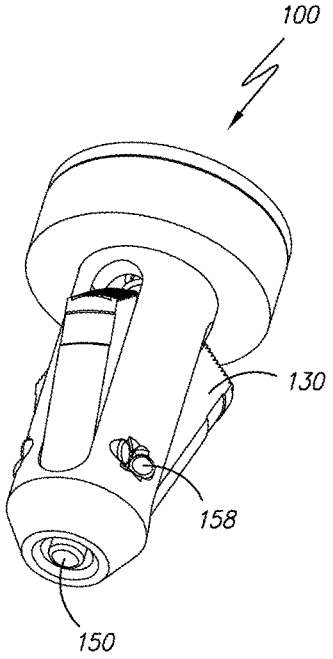
FIG. 9A is a perspective view of a push pin of the present invention.
Figure 9B:
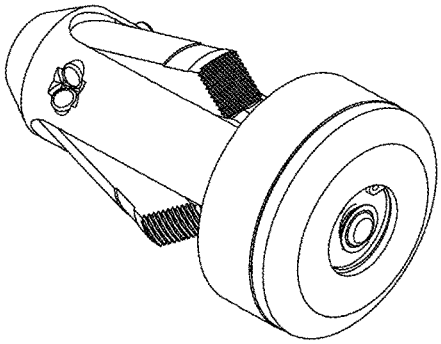
FIG. 9B is another perspective view of the push pin of FIG. 9A.
Figure 9C:
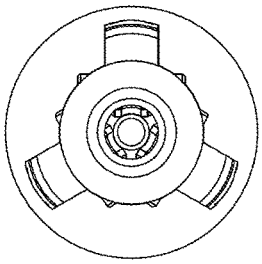
FIG. 9C is an end view of the push pin of FIG. 9A.
Figure 9D:
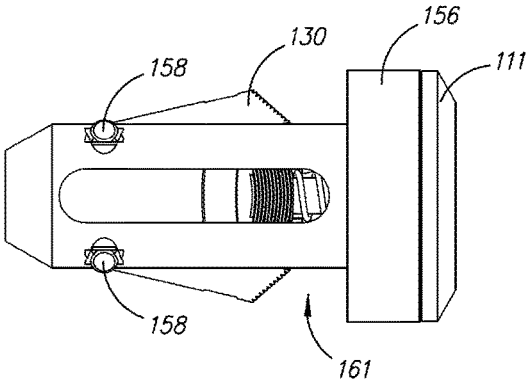
FIG. 9D is a side view of the push pin of FIG. 9A.

Termination bracket may be attached to the monopole using fasteners, which may be anchor bolts or any other suitable fastener. In a preferred embodiment, the fasteners are push pins 100 (FIG. 9A). Reinforcing rod 3 may be tightly attached to termination bracket 70 using top and bottom nuts 5 that are threaded on the rod and tightened against the top and bottom ends of cylinder 61 so as to prevent relative displacement between the rod and bracket. In the preferred embodiment of FIG. 8A, termination bracket 70 is sufficiently long and strong and adapted for assembly with a sufficient number of fasteners to support the entire compressive and tensile loads of the rod without transmission of such rod loads to the monopole tower at intermediate elevations.

Figure 2A:
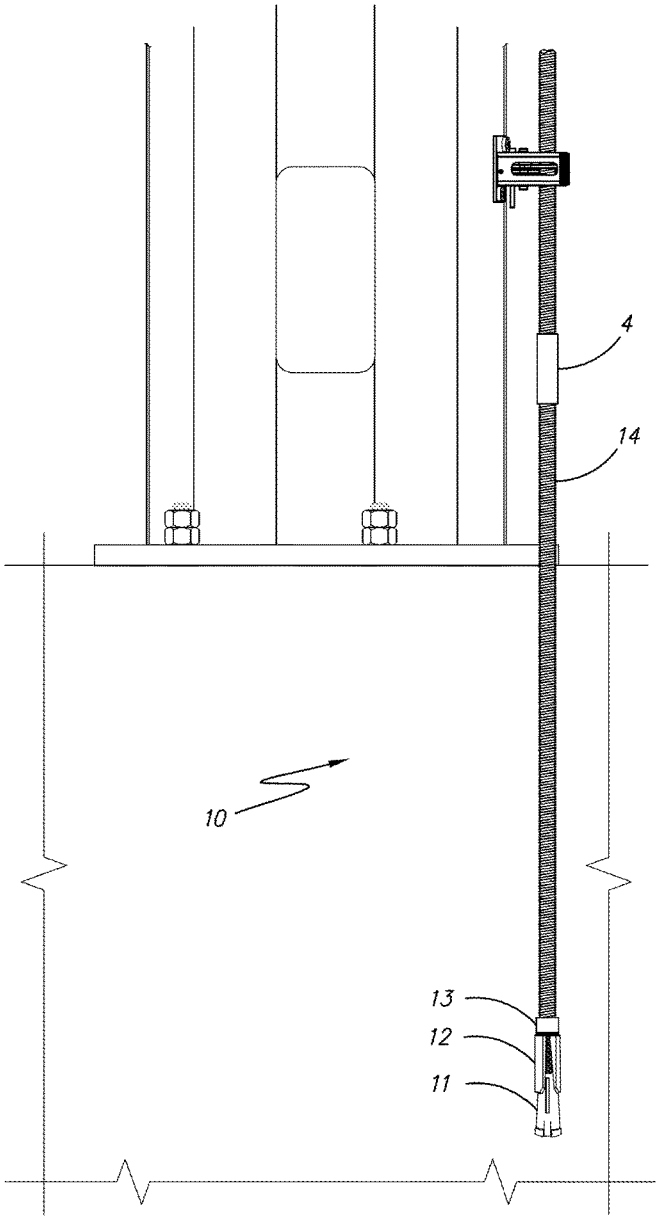
FIG. 2A is an elevation view of a bottom portion of the tower reinforcement system of FIG. 1 cutaway to show an anchor of the present invention.

With reference to FIG. 2A, in a preferred embodiment, anchor 10 may comprise a commercially available wedge anchor for making a mechanical wedge connection to the foundation that does not require grout or adhesive to make the connection. Said anchor may comprise a threaded anchor bar 14 with a thrust ring 13 on a lower portion of the bar and an expansion shell 12 fitted around anchor bar 14 with a clearance fit so that it may freely rotate relative to the bar. The upper end of said shell may be in contact with the downward facing surface of thrust ring 13. The anchor may further comprise a cone llconnected to bar 14, the upper portion of which is disposed within the bottom portion of said expansion shell 12. Cone 11 may have internal threads for making a threaded connection with the bar threads. The anchor may further comprise an anchor bar nut (not shown) threaded to the anchor bar above the foundation and tightened against the foundation. The anchor bar may be prestressed so as to improve its fatigue life and resistance to cyclic loading.

In operative deployment in a concrete foundation, the anchor is inserted cone-end-first a desired depth into a hole in the foundation. The expansion shell and hole are sized so that they have a snug fit. An anchor bar nut (not shown) may be tightened in contact with the foundation surface, or preferably with a washer or bearing plate disposed between the nut and foundation. The nut may be tightened against a base plate of the tower. Upon turning of the nut, the bar and cone translate toward the nut. The expansion shell is held in place by the walls of the hole. Turning of the nut also tightens the bar to the foundation, thus imparting tension preloading in the bar and compression preloading in the foundation. Tensioning of the bar may cause further insertion of the cone into the expansion shell, thus increasing the radial force between the shell and the foundation. Such preloading may reduce amplitudes of cyclic stress in the bar and foundation from cyclic loading imparted by the reinforcing rod, and thus increase fatigue life of the anchor and the foundation. A tight joint between the bar and foundation can be maintained through cyclic loads by applying a preload that exceeds expected operational tension loads applied on the anchor by the reinforcing member.

The present invention may comprise other commercially available mechanical wedge anchors that may form a connection to the foundation without grout or adhesive. Mechanical wedge anchors may be attached to the ground through other media than the above described concrete foundations, such as attachment directly to rock with suitable holes drilled into the rock. Connection of a reinforcing member to an anchor attached to a monopole foundation is considered herein to be a connection to the ground.

A method of monopole tower reinforcement of the present invention may comprise identifying the desired anchor location; boring an anchoring hole in the desired location to a desired depth and diameter; inserting the anchor into the hole to the desired insertion depth; and tightening the anchor bar. The tightening step may comprise turning the nut until the desired bar tension is achieved. The tightening step may comprise pulling on the upper portion of the bar to put it in the desired tension, such as pulling with a hydraulic tensioner. The tightening step may comprise a combination of pulling the bar in tension and turning the nut. The foregoing method steps may be performed independently with multiple anchors at locations around the monopole.

Figure 2B:
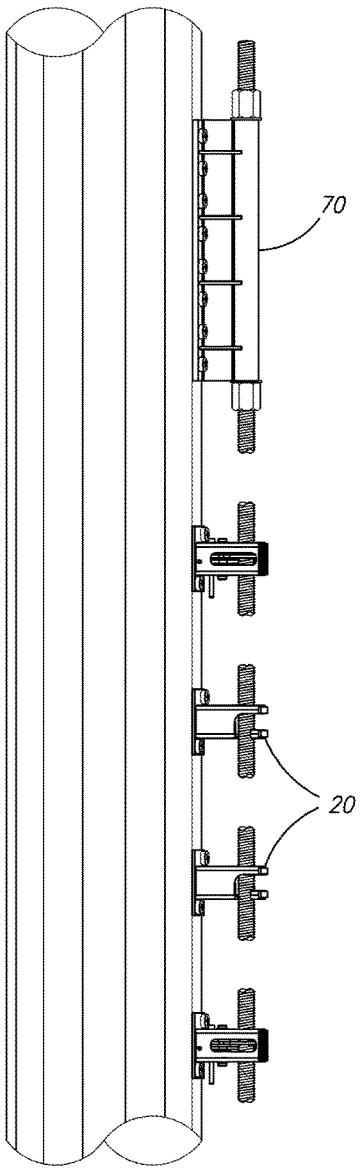
FIG. 2B is an elevation view of an upper portion of the tower reinforcement system of FIG. 1.
Figure 2C:
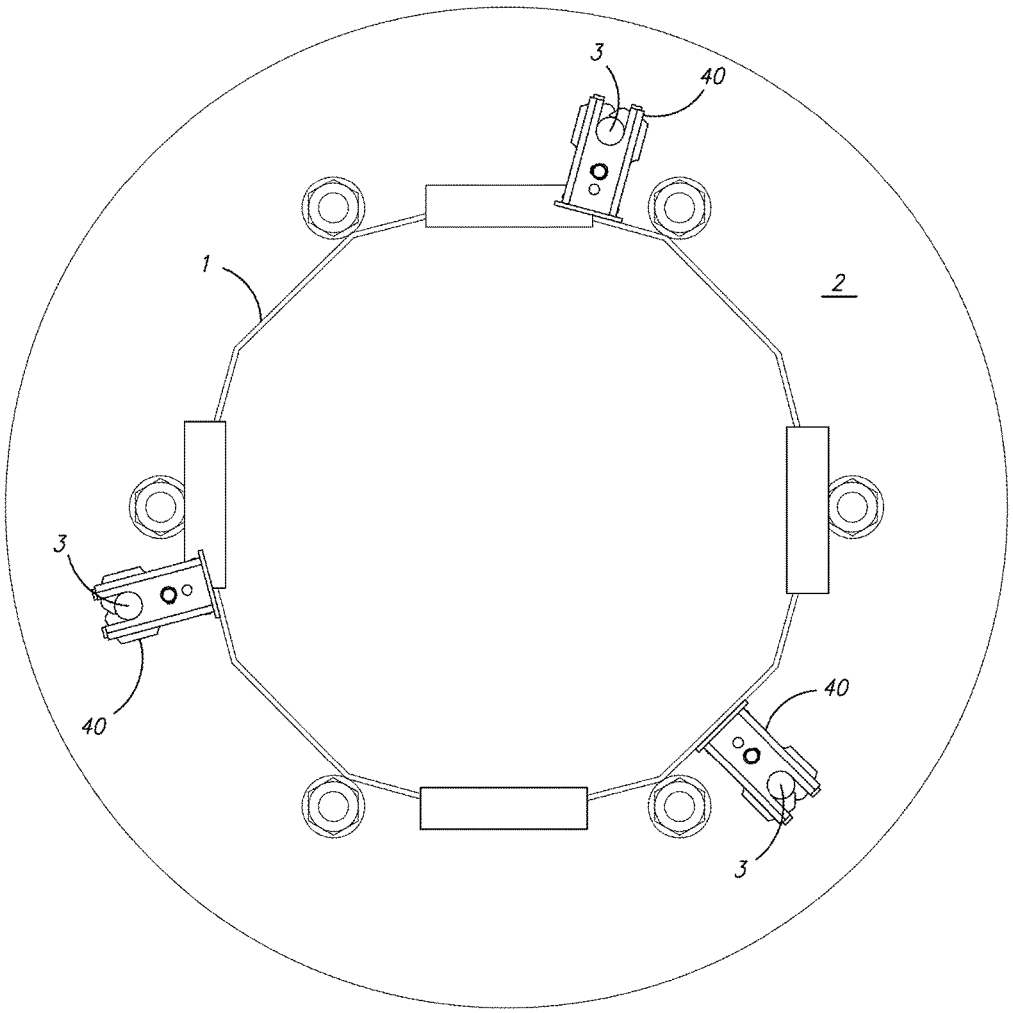
FIG. 2C is a top plan view of a portion of the tower reinforcement system of FIG. 1.
Figure 3A:
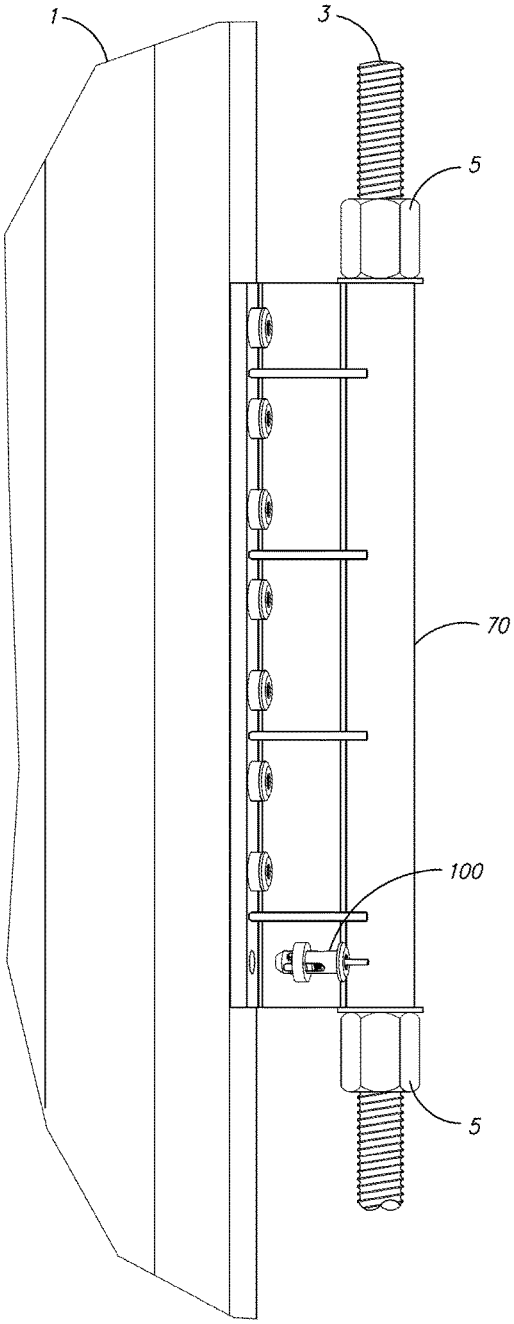
FIG. 3A is an elevation view of an assembly of a tower, support rod and termination bracket of the present invention with one push pin un-inserted.
Figure 3B:
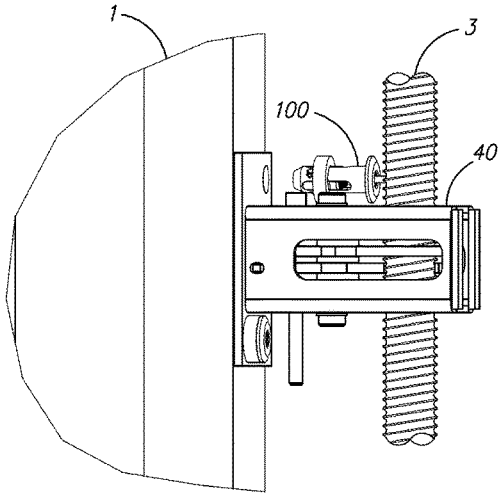
FIG. 3B is a an elevation view of an assembly of a tower, support rod and snap capture standoff of the present invention with one push pin un-inserted.
Figure 3C:
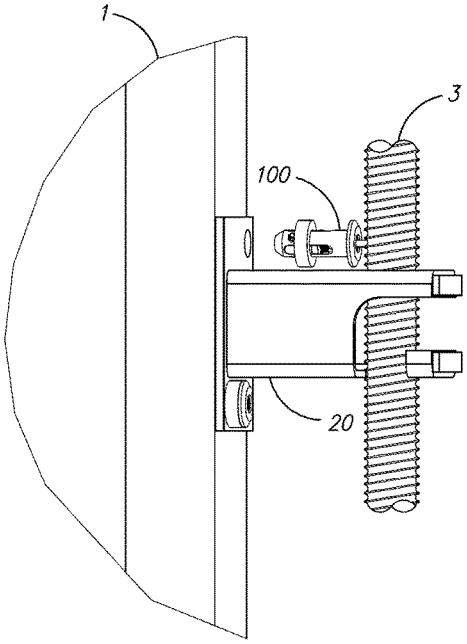
FIG. 3C is an elevation view of an assembly of a tower, support rod and slot-type standoff of the present invention with one push pin un-inserted.

With reference to FIGS. 1, 2B and 3C, in the preferred embodiment, reinforcing rod 3 may be stabilized to the monopole with standoffs 20 at one or more intermediate elevations between anchor 10 (see FIG. 1) and termination bracket 70. FIG. 3C shows one push pin 100 before insertion through aligned holes in the monopole and standoff flange.

With reference to FIGS. 4A-4D, in one embodiment standoff 20 comprises a body 21 made from hollow rectangular bar stock, proximal portion 22 adapted for attachment to monopole 1, and distal portion 23 adapted for receiving reinforcing rod 3. The proximal portion comprises flange 30 with holes 34 for receiving fasteners to attach the standoff to the monopole. Said fasteners may be anchor bolts, or any other suitable fastener for structures where access is available from only one side. If access is available to the other side, then the fastener may be any suitable fastener, such as a nut and bolt, for example. In a preferred embodiment, the fasteners are push pins 100 (FIG. 9A).

With further reference to FIGS. 4A-4D, the distal portion of the standoff comprises a first extension 24 and second extension 25 that are spaced vertically apart from one another, forming opening 27 in the distal end of the standoff First extension 24 is configured so as to form pocket 33 opened to the left. Second extension 25 is configured so as to form pocket 36 opened to the right. Pockets 33 and 36 are aligned so as to define a restraint with an upwardly oriented opening 26 for receiving reinforcing rod 3. The restraint may completely surround the rod or may partially surround the rod a sufficient distance so as to capture the rod in desired sideways directions.

Opening 27 is in communication with opening 26 so that a reinforcing rod may be inserted sideways through opening 27 and then disposed in opening 26 by twisting the standoff about the standoff s longitudinal axis. Said insertion and said twisting indicate relative motion between the standoff and rod and may be accomplished by manipulating the standoff, or rod, or both. In the embodiment shown in FIGS. 4A-5G, a quarter turn of the standoff disposes the rod upright in opening 26. When disposed upright in opening 26, reinforcing rod 3 is captured so that lateral deflection of the rod is limited by the standoff Thus, the standoff spaces the rod at the desired distance from the monopole and stabilizes the rod against buckling under compressive loads.

The standoff and rod may be sized and shaped relative to one another to provide the desired fit of the rod within opening 26, ranging from a clearance fit to an interference fit. For snug or interference fit, additional rotation force may be applied to dispose the rod in opening 26.

Thus, standoff 20 and reinforcing rod 3 need not be tightly attached to one another. Thus, the standoff may provide lateral stability to the rod while allowing relative vertical displacement between the rod and standoff Thus loads on the standoff caused by such relative vertical displacement may be avoided or reduced. In the preferred embodiment, standoffs are structurally sufficient to accommodate all loading conditions for a tight fit or loose fit with the rod.

Figure 4A:
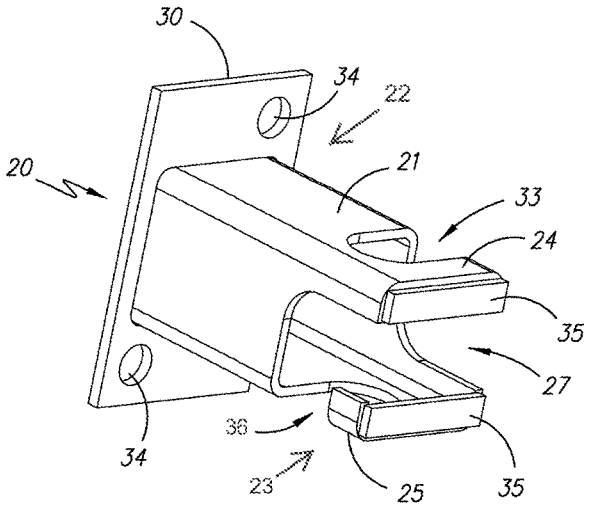
FIG. 4A is a perspective view of a standoff of the present invention.
Figure 4B:
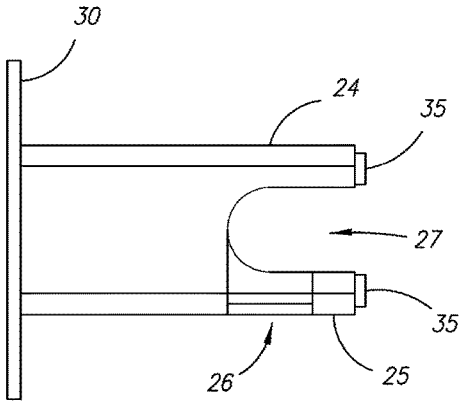
FIG. 4B is a side view of the standoff of FIG. 4A.
Figure 4C:
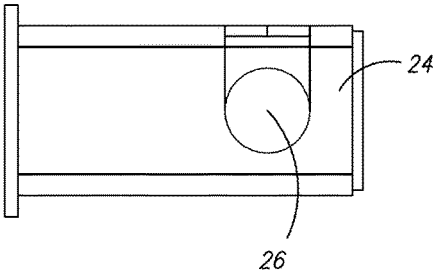
FIG. 4C is a top view of the standoff of FIG. 4A.
Figure 4D:
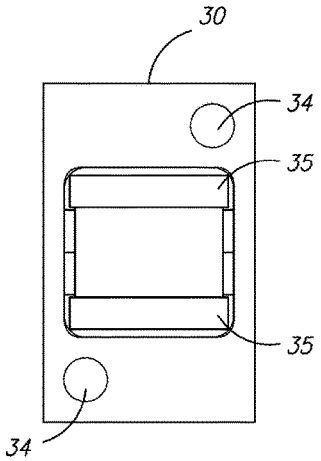
FIG. 4D is an end view of the standoff of FIG. 4A.
Figure 5A:
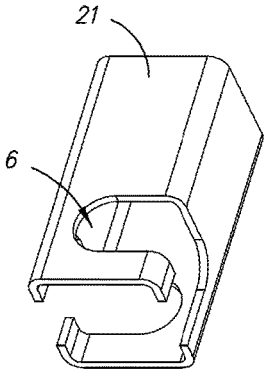
FIG. 5A is a perspective view of a standoff body of FIG. 4A.
Figure 5B:
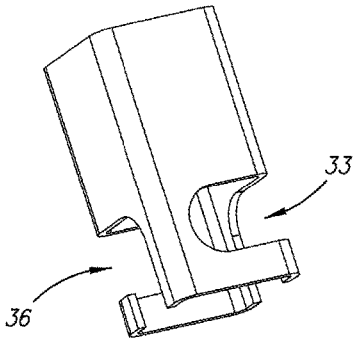
FIG. 5B is another perspective view of a the standoff body of FIG. 5A.
Figure 5C:
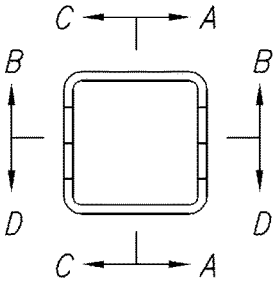
FIG. 5C is a front view of the standoff body of FIG. 5A.
Figure 5D:
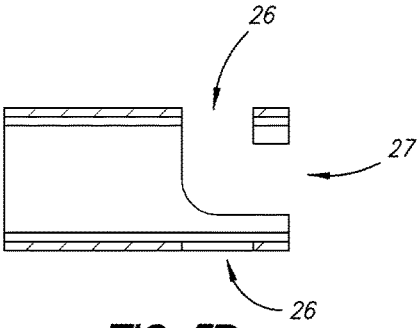
FIG. 5D is a section A-A view of FIG. 5C.
Figure 5E:
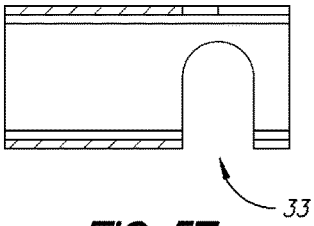
FIG. 5E is a section B-B view of FIG. 5C.
Figure 5F:
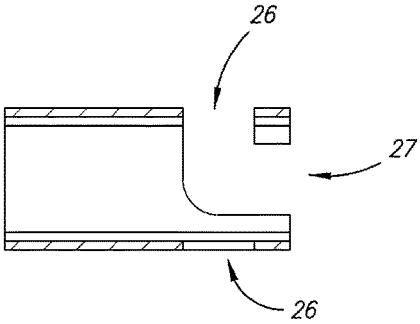
FIG. 5F is a section C-C view of FIG. 5C.
Figure 5G:
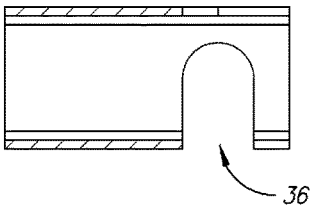
FIG. 5G is a section D-D view of FIG. 5C.

The standoff design of FIG. 4A of the present invention provides a range of assembly methods. With a clearance fit of reinforcing rod 3 within standoff opening 26, final alignment of the standoff with the monopole may be accomplished with little or no resistance from the rod after the rod is disposed within the standoff. On the other hand, a snug fit of the reinforcing rod within the opening may hold the standoff securely in position on the rod.

Standoff 20 may comprise end caps 35 welded or otherwise manufactured on the ends of extensions 24 and 25.

With reference to FIGS. 6A-7E, an alternate embodiment of the present invention comprises snap capture standoff 40 for stabilizing reinforcing rod 3 at one or more intermediate elevations. In the embodiment shown, snap capture 40 comprises a body 41 made from hollow rectangular bar stock. It further comprises a flange 42 on its proximal end with holes 58 in the flange for receiving fasteners to attach the standoff to the monopole.

With further reference to FIGS. 6A-7E, the distal portion of the standoff comprises spaced-apart extensions 59 that form a vertically oriented opening 44 between them for receiving reinforcing rod 3. Body 41 comprises left and right side openings 43 (FIGS. 7A and 7B) for receiving latch fingers 46 and 47, top and bottom holes 61 (FIG. 7C) that are aligned with one another for receiving lock pin 52, and top and bottom holes 62 (FIG. 7C) that are aligned with one another for receiving pivot pin 50. Standoff 40 may comprise end caps 45 welded or otherwise manufactured on the ends of extensions 59.

With further reference to FIGS. 6A-7E, snap capture standoff 40 further comprises pivot pin 50 disposed upright through holes 62. Latch fingers 46 and 47 are disposed horizontally in body 41 and rotatably attached to pivot pin 50 so as to be rotatable between an open position (FIG. 6F) and closed position (FIG. 6B). A spacer 49 is disposed between fingers 46 and 47, a spacer 48 between finger 46 and body 41, and a spacer 48 between finger 47 and body 41. For each finger 46 and 47, a spring 51 is disposed in compression between the body wall and a rear portion of the finger so as to apply a force to pivot each finger about pivot pin 50 to the closed position. A pushrod 65 (FIG. 7J) is disposed longitudinally inside each spring 51 and slidably disposed in a hole in the side of the proximal portion of the standoff body 41.

Figure 6A:
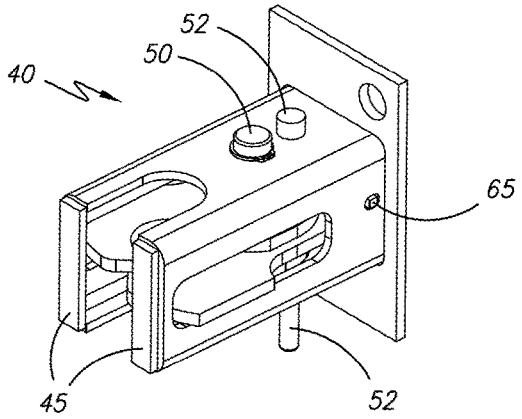
FIG. 6A is a perspective view of another embodiment of the standoff of the present invention in the closed configuration.
Figure 6B:
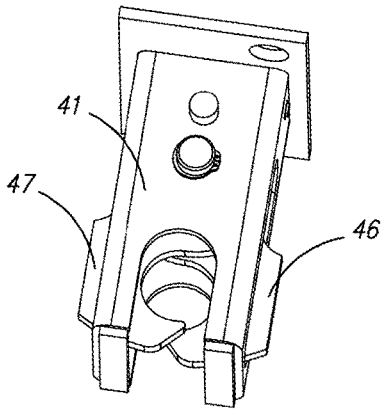
FIG. 6B is another perspective view of the standoff of FIG. 6A.
Figure 6C:
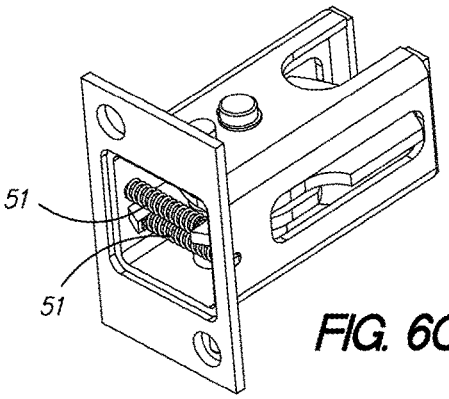
FIG. 6C is another perspective view of the standoff of FIG. 6A.
Figure 6D:
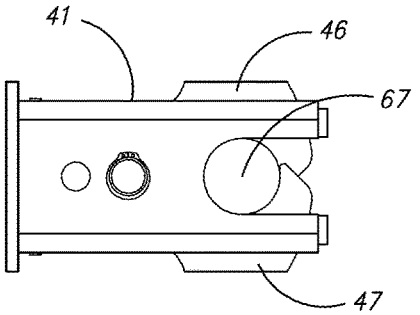
FIG. 6D is a top view of the standoff of FIG. 6A.
Figure 6E:
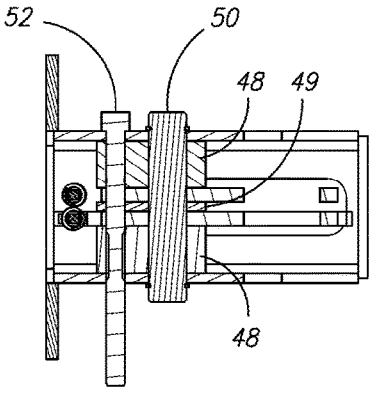
FIG. 6E is a side section view of the standoff of FIG. 6A sectioned down the middle.
Figure 6F:
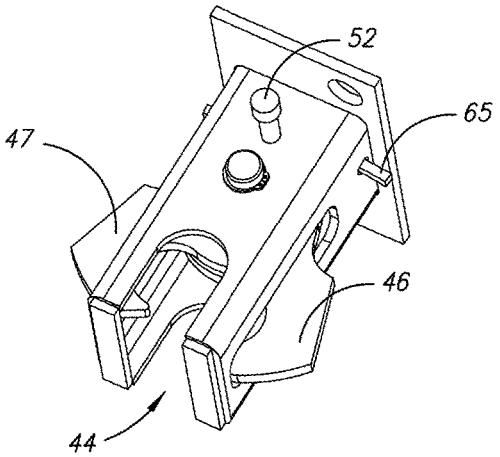
FIG. 6F is a perspective view of the standoff embodiment of FIG. 6A in the open configuration.

With reference to FIG. 6F, latch fingers are held in the open position by lock pin 52 disposed through holes 61 (FIG. 7C) in body 41. With pin 52 in the upper position shown in in FIG. 6F, the distal shaft portion 57 (FIG. 7H) of lock pin 52 is disposed through the outboard side lobe 68 of pinched slot 64 (FIGS. 7F and 7G) in the rear portion of each latch finger. In the open position, pushrods 65 extend outward of body 41.

Figure 7A:
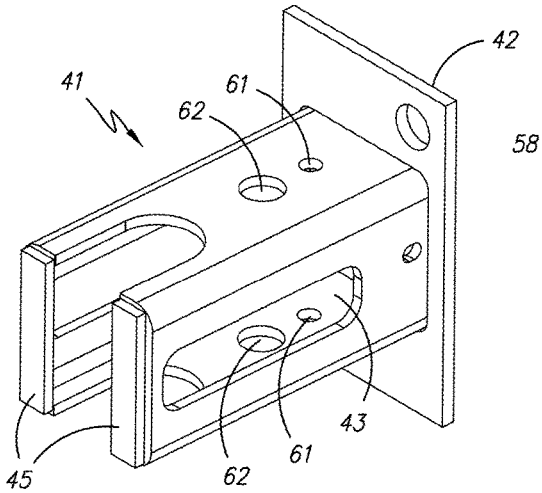
FIG. 7A is a perspective view of the standoff body of FIG. 6A.
Figure 7B:
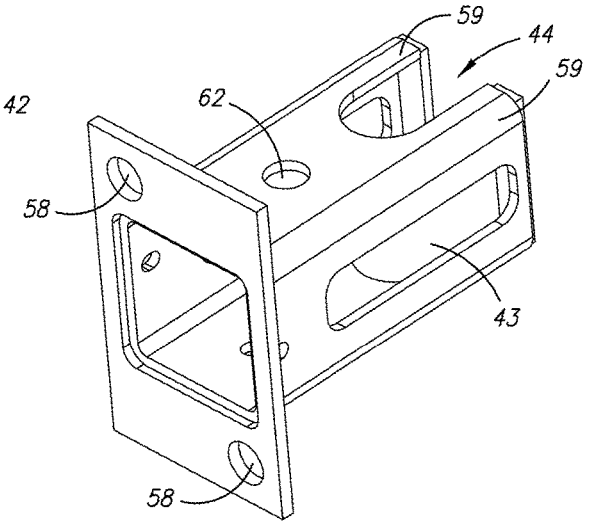
FIG. 7B is another perspective view of the standoff body of FIG. 7A.
Figure 7C:
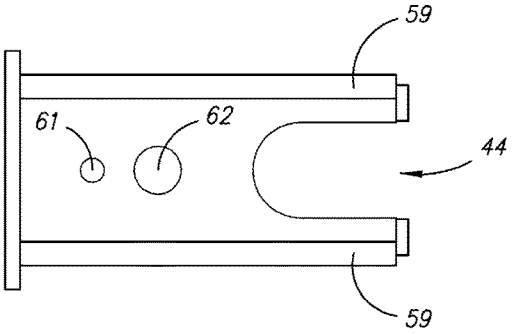
FIG. 7C is a top view of the standoff body of FIG. 7A.
Figure 7E:
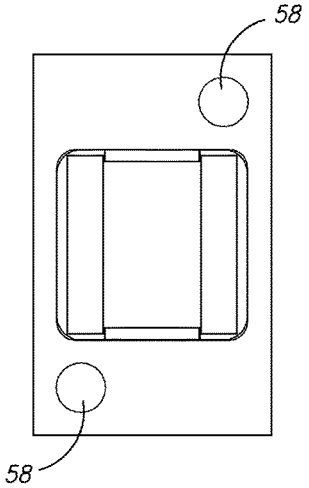
FIG. 7E is a front view of the standoff body of FIG. 7A.
Figure 7D:
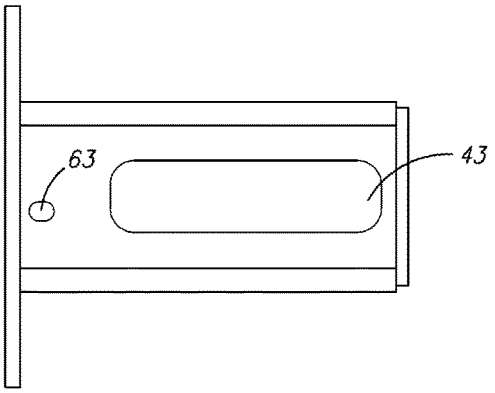
FIG. 7D is a side view of the standoff body of FIG. 7A.
Figure 7F:
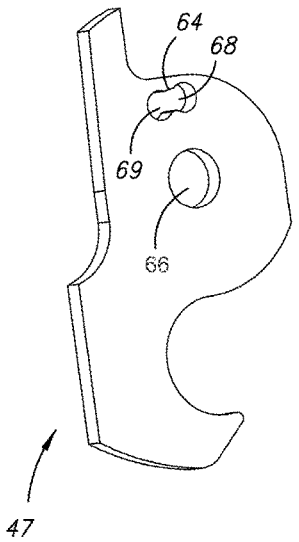
FIG. 7F is a perspective view of a latch finger of the present invention.
Figure 7G:
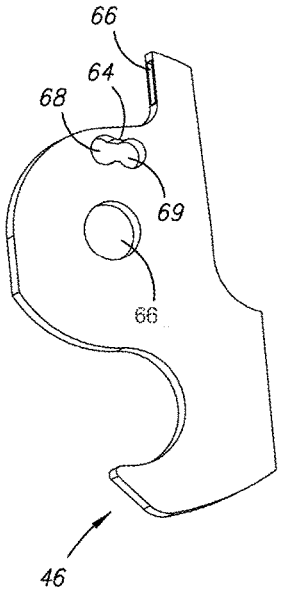
FIG. 7G is a perspective view of another latch finger of FIG. 7A of the same configuration as the latch finger of FIG. 7F.
Figure 7H:
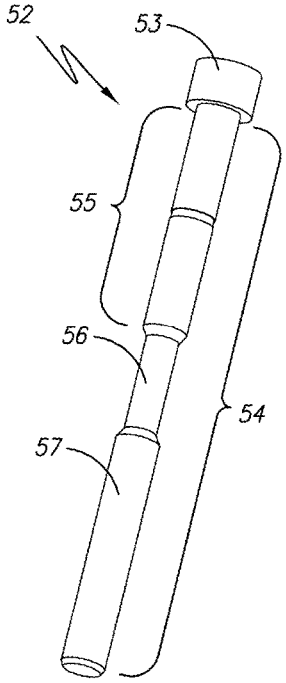
FIG. 7H is a perspective view of a lock pin of the present invention.
Figure 7I:
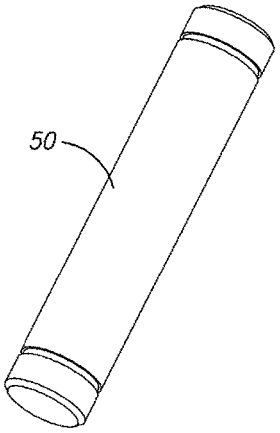
FIG. 7I is a perspective view of a pivot pin of the present invention.
Figure 7J:
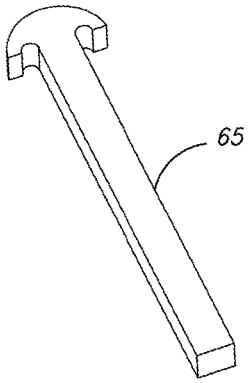
FIG. 7J is a perspective view of a pushrod of the present invention.

With reference to FIGS. 7F and 7G, each latch finger has a hole 66 for receiving pivot pin 50. The rear portion of each latch finger has a pinched slot 64 with an inboard side lobe 68 and outboard side lobe 69 for receiving lock pin shaft 54. The lobes on both sides are large enough to receive the proximal portion 55 and distal portion 57 of shaft 54. Between the lobes is a pinched neck portion of the slot that is narrower than the lobes. The neck of slot 64 is narrower than the diameter of the proximal portion 55 and distal portion 57 of shaft 54 and wider across than the diameter of the middle portion 56 of the shaft. In the open position, the fingers cannot close because the proximal shaft portion cannot pass through the narrow neck.

By applying a first external force, such as a downward hammer blow to head 53, Lock pin 52 may be moved to an intermediate position in which the middle shaft portion 56 is disposed in slots 64. The diameter of the middle shaft portion is smaller than the slot neck width, so the fingers are free to rotate about the pivot pin. Fingers thus close under the force of springs 51. In the closed position, lock pin shaft 54 is disposed through the inboard side lobe 68 finger pockets 64. The lock pin may be further moved to a lower position in which the proximal shaft portion 55 is disposed through the inboard side lobe. The diameter of proximal shaft portion 55 is greater than the slot neck width and cannot pass through the neck, thus the fingers cannot pivot and are locked closed.

With reference to FIG. 6D, in the closed position, fingers 46 and 47, body 41 and body extensions 59 cooperate to form a restraint having an upwardly oriented opening 67 for receiving a reinforcing rod 3. When disposed upright in opening 67, reinforcing rod 3 is captured so that lateral deflection is limited by the standoff Thus, the standoff stabilizes the rod and spaces the rod at the desired distance from the monopole. The fit of the rod within opening 67 may be in the range from a clearance fit to an interference fit. The restraint may completely surround the rod or may partially surround the rod a sufficient distance so as to capture the rod in desired sideways directions.

Assembly of the reinforcing rod 3 and standoff 40 may be accomplished by providing standoff 40 with fingers open and lock pin 52 up; and then inserting an upright rod sidewise through opening 44 until the rod contacts body 41. Then, downward force may be applied to lock pin 52 to move it to the intermediate position where middle shaft portion 56 is disposed in slot 64. In that position, springs 51 pivot the fingers 46 and 47 about pivot pin 50. Said pivoting closes the fingers around reinforcing rod 3. Rod 3 is thus disposed in opening 67, and lock pin 52 is dispose in the inboard side lobe 68 of slot 64 of each latch finger. Lock pin is then moved into position where proximal shaft portion 55 is disposed in the inboard side lobes 68, thus locking the fingers closed. Further downward movement of lock pin 52 is prevented by contact between the underside of head 53 and upper surface of standoff body 41.

Movement of lock pin 52 from the upper to lower position may be in a continuous movement with a single application of downward force or in incremental movements with multiple applications of successive downward forces. If done with a single application of force, the springs will close the fingers during the transitory movement of the pin through the intermediate position in which middle shaft portion 56 is disposed in slot 64 of each finger 46 and 47.

In an embodiment of the reinforcing system comprising snap capture standoffs 40, the method of reinforcing a monopole may comprise attaching multiple vertically spaced apart standoffs to the monopole in vertical alignment with one another. Then the reinforcing rod 3 may be inserted into said vertically aligned standoffs simultaneously by a sideways movement of the reinforcing rod. Then, the latch fingers for each standoff may be closed around the rod by application of downward force on lock pin 52 of each standoff.

Additional steps for reinforcing a monopole may comprise: assembling termination bracket 70 to monopole 1; assembling the termination bracket to reinforcing rod 3; assembling anchor 10 to the foundation; and assembling reinforcing rod 3 to the anchor. For embodiments comprising multiple rod segments, additional steps of coupling the rod segments together may be performed. Couplings 4 (FIGS. 1 and 2A) may be used to couple rod segments together endwise.

For reinforcement systems comprising multiple anchor and rod installations spaced around the monopole, the installation steps may be performed independently among them. Alternatively, the steps may be coordinated and the steps of assembling the rod to the termination bracket and the termination bracket to the monopole may be reserved for last so that those steps may be performed for each rod in unison or in sequence. Likewise, the steps of attaching the rod to the anchor may be reserved for last performed for each rod in unison or in sequence.

The steps in the installation processes have no order limitation unless expressly recited or implicitly required.

Other embodiments of the present invention comprise a single-finger spring actuated snap capture standoff that may comprise the same operative componentry as the dual-finger standoff of FIG. 6A, except one less finger. The single finger in such embodiment cooperates with the standoff body and extensions to form an opening for capturing an elongated reinforcing member.

A nut may be provided on the reinforcing rod below standoffs 20 or 40 for positioning purposes. Nuts may be provided above and below standoffs 20 and 40 and tightened against the standoff to tightly secure the rod and standoff together.

Figure 10A:
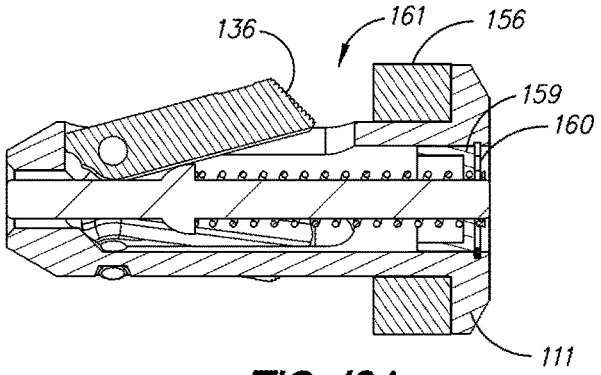
FIG. 10A is a side view of a vertical section down the centerline of the push pin of FIG. 9C.

With reference to FIGS. 9A-11C, one embodiment of push pin 100 comprises a body 110 (FIG. 11A) having a shaft 112 and a head 111, and three retractable blades 130 that are movable between a retracted position (FIG. 10B) and an extended position (FIG. 10A). With reference to FIG. 10C, the push pin may be deployed by inserting it into aligned holes of two objects 300 and 400, whereupon the blades extend outwardly to retain the objects between the blades and head (FIG. 10C).

Figure 11A:
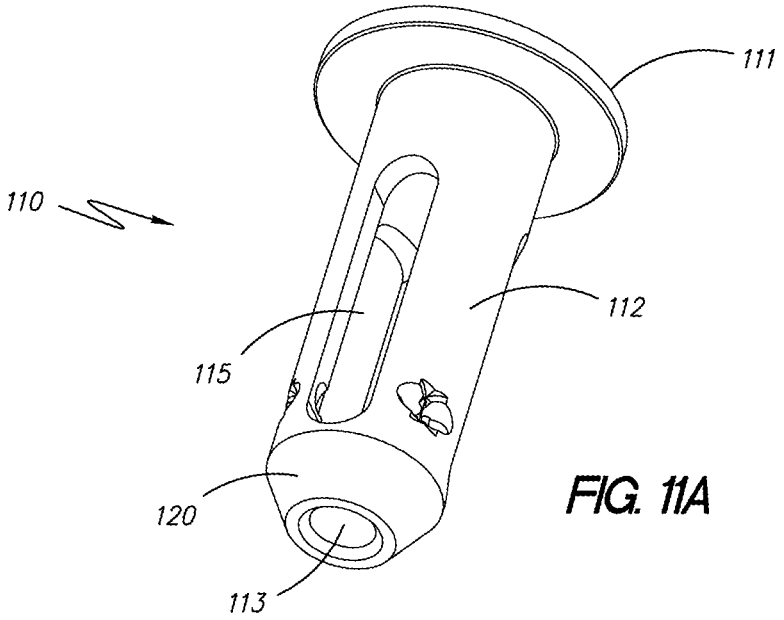
FIG. 11A is a perspective view of a push pin body of the present invention.
Figure 11B:
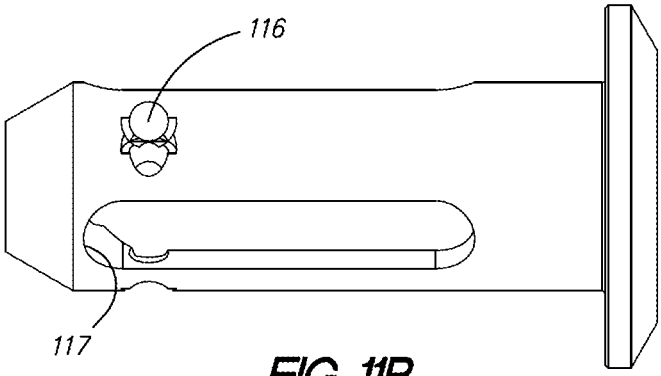
FIG. 11B is a side view of the push pin body of FIG. 11A.
Figure 11C:
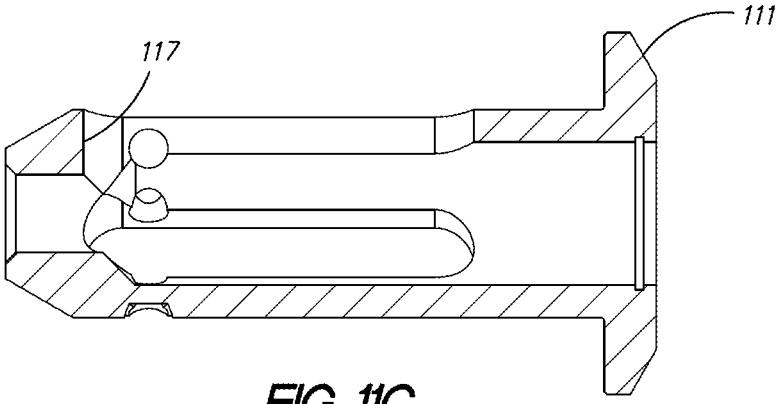
FIG. 11C is a side view of a vertical section down the centerline of the push pin body of FIG. 11A.
Figure 12A:
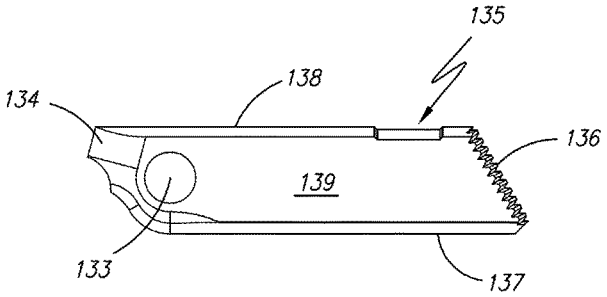
FIG. 12A is a side view of a push pin blade of the present invention.

With reference to FIGS. 11A-11C, push pin body 110 comprises center chamber 113, three sets of pin holes 116 in the distal portion of shaft 112 for each receiving a pivot pin 158 (FIG. 9D), and three openings 115 in the shaft for each receiving a blade 130 (FIGS. 9A and 12A). The distal end of body 110 has chamfered surface 120 to guide entry into a hole. In a preferred embodiment, shaft 112 and chamber 113 are generally cylindrical and may each vary in diameter along their respective longitudinal extent.

Figure 12B:
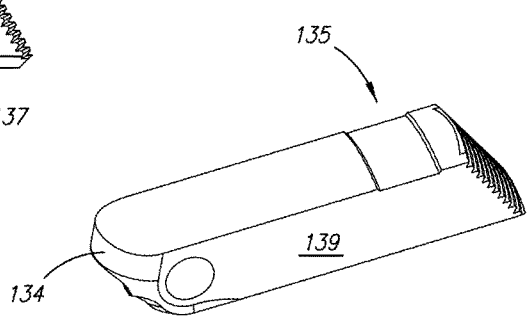
FIG. 12B is a perspective view of the push pin blade of FIG. 12A.
Figure 12C:
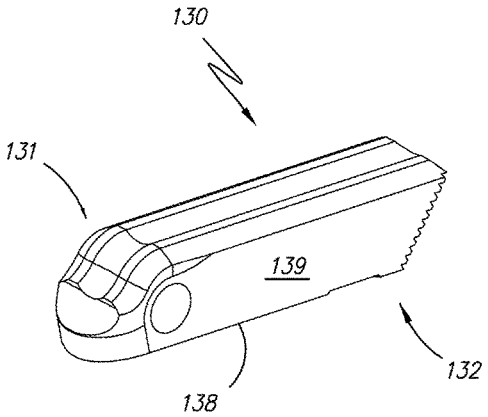
FIG. 12C is another perspective view of the push pin blade of FIG. 12A.

With reference to FIGS. 12A-12C, each blade 130 comprises a pinned end portion 131, free end portion 132, a pin hole 133 in the pinned end portion, and a contact surface 136 at the free end. Contact surface 136 is disposed at an acute angle to the interior side 137 of the blade. Contact surface 136 may have surface features such as knurls, striations, corrugation, ridges, grooves, dimples, or course surface roughness. The pinned end has a stop surface 134 for contacting an opposing stop surface of the pin body when the blade is fully deployed. Exterior side 138 of the blade may have a slight recess 135 for releasably receiving the inside surface of retainer ring 156 (FIG. 10B) for releasably positioning retainer ring in a desired position on the push pin prior to deployment.

With further reference to FIGS. 9A and 11A, blade 130 is disposed through slot 115 of body 110 (FIG. 11A). Pin hole 133 (FIG. 12A) of said blade is aligned with pin holes 116 of the body, and pivot pin 158 is disposed through holes 116 and 133 so as to rotatably attach the blade to the body.

Blade 130 is rotatable between a retracted position (FIG. 10B) and an extended position (FIG. 10A). In the retracted position, the blade is sufficiently retracted within body 110 so as to fit through a hole in an object intended to receive the push pin for operative assembly.

A retainer ring 156 may be slidably disposed around the push pin so as to retain blade 130 in the retracted position prior to operative deployment of the push pin. The retainer ring may secure the push pin in deployment-ready configuration and protect the push pin from damage during shipping and handling.

Figure 10B:
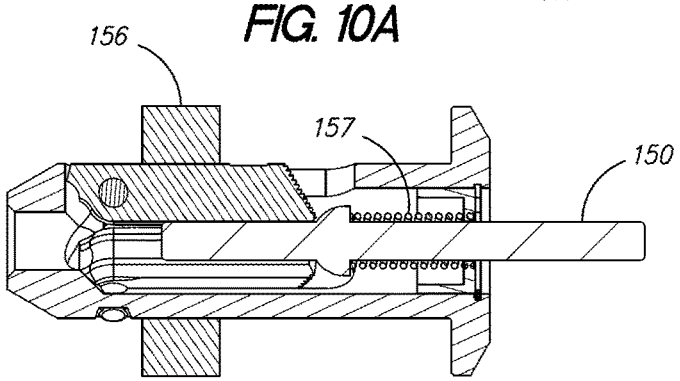
FIG. 10B is the view of FIG. 10A modified to show blades retracted and retainer ring placed around the blades.
Figure 12D:
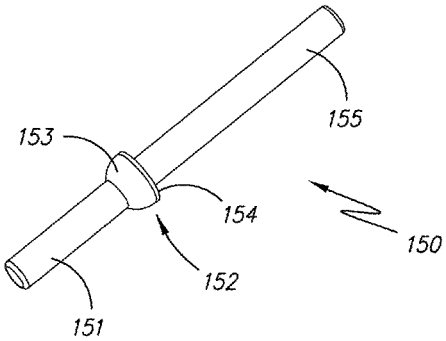
FIG. 12D is a perspective view of a actuator pin of the present invention.

In further reference to FIGS. 10A and 10B, a preferred embodiment of push pin 100 comprises actuator pin 150 disposed in center chamber 113 (FIG. 11A). In reference to FIG. 12D, actuator pin 150 comprises a front shaft portion 151, rear shaft portion 155, and knob 152 between the front and rear shaft portions. Knob portion 152 protrudes outwardly and has a sloped front surface 153 and rear shoulder surface 154. Helical compression spring 157 is disposed around the rear shaft portion 155 of the actuator pin and is compressed longitudinally between shoulder surface 154 of the actuator pin and a spring retention bushing 159 (FIG. 10A). Retention bushing 159 is disposed in center chamber 113 of the push pin, rearward of spring 157. The bushing is captured in place by a snap ring 160 disposed in a circumferential slot in the side wall of center chamber 113.

Spring 157 applies a forward force on actuator pin 150. In the pre-deployment configuration of FIG. 10B, retainer ring 156 keeps blades 130 retracted, knob 152 abuts against the free end of blades 130, and front shaft portion 151 contacts interior sides 137 of blades 130. Upon sliding retainer ring 156 to the position shown in FIG. 10A to release blades 130, spring 157 pushes the actuator pin forward, causing knob 152 to wedge between blades 130 and to pivot them outward to their extended position shown in FIG. 10A. Interior side 137 of the blade may have a longitudinal groove to accommodate shaft portion 155 in the retracted position and guide the knob surface 153 as it moves along the blade. In their fully extended position, stop surface 134 of the blade contacts stop surface 117 (FIG. 11B) of push pin body 110 to prevent further outward pivoting of the blade. In the extended configuration shown in FIG. 10A, there is a space 161 between the retainer ring and contact surface 136 of the blade. In the preferred embodiment shown, space 161 tapers narrower in the radially inward direction.

Figure 10C:
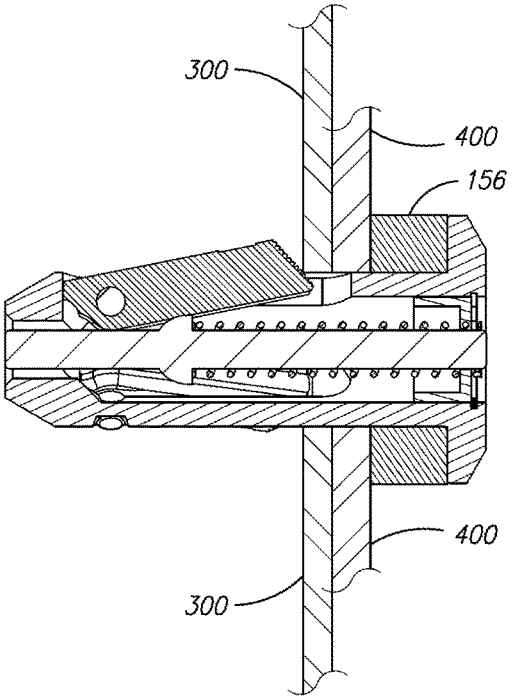
FIG. 10C is the view of FIG. 10A modified to show fastened parts.

The push pin may be used to connect two objects together where the objects are of appropriate thickness and are provided with through holes of appropriate diameter. For such an application, the through holes are aligned and the push pin is pushed through the holes. The blades deploy and the objects are held between contact surface 136 and retainer ring 156 (FIG. 10C). Spring 157 and actuator pin 150 hold blades 130 in their extended position and capture the push pin so as to prevent it from backing out of the holes. Sloped contact surface 136 forming tapered space 161 permits application over a range of object thicknesses. Push pins may be provided in a range of sizes and shapes and may be customized to fit any application. To accommodate different object thicknesses, washers 156 of different thickness may be provided or multiple washers may be used to adjust the size of tapered space 161.

In an embodiment in which a retainer ring is not used, objects may be in direct contact with the head of the push pin and held between the blades and the head.

The preferred embodiment of FIG. 10A comprises an actuator pin, but any means of spring actuation of the blades may be used, such as a spring-actuated ball bearing disposed at the front end of the spring. In the preferred embodiment, the actuator pin is accessible through either end of the center chamber 113 in push pin body 110 so that it may be pushed or pulled against the spring to allow retraction of the blades to set or reset the push pin to the pre-deployment configuration of FIG. 10B.

In a preferred embodiment, the push pin is configured so that blades 130 pivot in plane with the centerline of the push pin, the blades are evenly spaced an angular distance apart from each other around the centerline, and the push pin generally has ⅓ angular symmetry. Although a preferred embodiment of the push pin has three blades, any number of blades any be used. For example, another embodiment may be quarter-symmetrical and comprise four blades. Other embodiments may be asymmetric.

A method of use of the push pin to fasten a plurality of objects having aligned holes may comprise the steps of: providing a push pin; inserting the push pin through the aligned holes; and allowing the blades to extend outwardly. The foregoing inserting step may comprise applying an external driving force against the head end of the push pin in the longitudinal direct. Said external force may comprise a hammer blow. The insertion step may further comprise the step of partially inserting the push pin before applying the driving force.

Optionally, the push pin may be provided with a retainer ring slidably disposed around the push pin so as to hold the blades in the retracted position. In this embodiment, the push pin may be partially inserted in the holes to the point where the retainer ring contacts an object surface. The partial insertion step may be followed by a full insertion step in which the driving force is applied and the push pin is fully inserted to the point where the retainer ring contacts the head of the push pin. The full insertion step causes the retainer ring to slide along the push pin body out of the way of the blades.

In applications involving multiple push pins, the push pins may be inserted independently of one another. Alternatively, the partial insertion step may be performed on two or more push pins before the full insertion step is performed on either or any of said two or more push pins. Thus, objects may be releasably held in alignment by partial insertion of multiple push pins before a full insertion step is performed on a push pin. After the partial insertion step and prior to the full insertion step is performed on a push pin, the push pin may be backed out of the hole. After the full insertion step is performed on a push pin, the push pin is captured in the hole and may only be backed out after applying external force on the actuator pin and moving said actuator pin rearwardly until knob 152 clears the blade path of travel so that the blade may be retracted.

Push pins 100 may be used to attach standoffs 20 and 40 to a monopole tower 1 by aligning standoff holes 58 with holes in the tower and inserting push pins into the aligned holes as described above. The insertion step may be preceded by drilling holes into the monopole for receiving the push pins. Likewise, push pins may be used to attach termination brackets 70 to a monopole.

While the invention has been particularly shown and described with reference to certain embodiments, it will be understood by those skilled in the art that various changes in form and details may be made to the invention without departing from the spirit and scope of the invention as described in the following claims.

We claim:

1. A monopole tower reinforcement apparatus comprising:

an upwardly extending elongated reinforcing member capable of supporting longitudinal compressive loads;

said reinforcing member attached to the monopole at an upper connection at a height above the ground;

a standoff attached to the tower at a height above the ground and below said upper connection, said standoff comprising an open end for receiving sideways insertion of said reinforcing member and an upwardly oriented opening spaced a distance laterally outward from the tower;

said reinforcing member disposed through said upwardly oriented opening so as to be deflection-limited laterally by the standoff.

2. The apparatus of claim 1 wherein the reinforcing member comprises at least two member segments coupled together endwise.

3. The monopole tower reinforcement apparatus of claim 1 wherein the reinforcing member is unbound vertically in said opening.

4. The monopole tower reinforcement apparatus of claim 1 wherein the reinforcing member has a clearance fit with the upwardly oriented opening.

5. The monopole tower reinforcement apparatus of claim 1 wherein the reinforcing member comprises a rod.

6. The monopole tower reinforcement apparatus of claim 5 wherein the reinforcing member comprises a threaded rod.

7. The monopole tower reinforcement apparatus of claim 1 wherein the upwardly extending elongated reinforcing member is connected to the ground outboard of the monopole.

8. The monopole tower reinforcement apparatus of claim 7 wherein the connection between the reinforcing member and ground comprises an anchor anchored to the ground and the reinforcing member attached to the anchor.

9. The monopole tower reinforcement apparatus of claim 8 wherein the anchor comprises a mechanical anchor.

10. The monopole tower reinforcement apparatus of claim 1 further comprising:

at least one fastener hole in the monopole and at least one fastener hole in the standoff, wherein said holes are aligned;

a fastener for attaching the standoff to the monopole, said fastener comprising;

a body having a head and a shaft; and at least one retractable member connected to the body and movable between a first position in which at least a portion of the member is retracted within the shaft and a second position in which at least a portion of the member is extended outward of the shaft, wherein:

said fastener is disposed through said aligned holes and said retractable member is extended so as to attach the standoff and monopole together in a space between the member and the head of the fastener body.

11. The monopole tower reinforcement apparatus of claim 1 further comprising a means for releasably attaching the standoff to the monopole, wherein said means is adapted for engaging an interior wall of a hollow monopole and where access to said means is only available from the outboard side of the monopole.

12. The monopole tower reinforcement apparatus of claim 1 wherein the upwardly extending elongated reinforcing member is tightly connected to an object below the standoff.

13. A monopole tower reinforcement apparatus comprising:

an upwardly extending elongated reinforcing member, capable of supporting longitudinal compressive loads, connected to the ground outboard of the monopole;

said reinforcing member attached to the monopole at an upper connection at a height above the ground;

a standoff attached to the tower at a height above the ground and below said upper connection, said standoff comprising an upwardly oriented opening spaced a distance laterally outward from the tower;

said reinforcing member disposed through said upwardly oriented opening so as to be deflection-limited laterally and unbound vertically by the standoff.

14. A monopole tower reinforcement apparatus comprising:

an upwardly extending elongated reinforcing member capable of supporting longitudinal compressive loads;

said reinforcing member attached to the monopole at an upper connection at a height above the ground; and a means for connecting said reinforcing member to the monopole at a height above the ground and below said upper connection.

15. The monopole tower reinforcement apparatus of claim 14 wherein the upwardly extending elongated reinforcing member is tightly connected to an object below the standoff.

16. The monopole tower reinforcement apparatus of claim 14 wherein the upwardly extending elongated reinforcing member is connected to the ground outboard of the monopole.

17. A method for reinforcing a monopole tower installed on a foundation comprising the steps of:

anchoring an elongated reinforcing member, capable of supporting longitudinal compressive loads, to the foundation;

identifying an upper elevation and intermediate elevation wherein the intermediate elevation is lower than the upper elevation;

tightly connecting said elongated reinforcing member to the tower at said upper elevation;

providing a standoff having an upwardly oriented opening for receiving the reinforcing member; and attaching the standoff to the tower and disposing the reinforcing member through said opening in the standoff at said intermediate elevation so as to provide lateral stability to the reinforcing member and freedom of vertical displacement between the reinforcing member and standoff.

18. The method of claim 17 wherein the attaching the standoff step comprises:

providing a fastener for attaching the standoff to the monopole, said fastener comprising;

a body having a head and a shaft; and at least one retractable member connected to the body and movable between a first position in which at least a portion of the member is retracted within the shaft and a second position in which at least a portion of the member is extended outward of the shaft:

inserting fastener into said aligned holes and allowing said retractable member to extended so as to attach the standoff and monopole together in a space between the member and the head of the fastener body.

19. A method for reinforcing a monopole tower installed on a foundation comprising the steps of:

identifying an upper elevation and intermediate elevation wherein the intermediate elevation is lower than the upper elevation;

tightly connecting an elongated reinforcing member, capable of supporting longitudinal compressive loads, to the tower at said upper elevation;

providing a standoff having an opening for receiving sideways insertion of the reinforcing member;

inserting the reinforcing member sideways through said opening in the standoff; and attaching the standoff to the tower at said intermediate elevation.

20. The method of claim 19 wherein the reinforcing member comprises a plurality of member segments and the method further comprises the step of coupling at least two of the plurality of segments together endwise.

21. The method of claim 19 further comprising the step of tightly connecting the elongated reinforcing member to an object below the standoff.

22. The method of claim 19 further comprising the step of anchoring the elongated reinforcing member to the foundation.

23. The method of claim 22 wherein the anchoring step comprises installing an anchor in the foundation and attaching the reinforcing member to the anchor.

24. The method of claim 23 wherein the step of installing an anchor in the foundation comprises installing a mechanical anchor in the foundation.

25. The method of claim 19 wherein the inserting step is performed after the tightly connecting step.

26. A method for reinforcing a monopole tower installed on a foundation comprising the steps of:

identifying an upper elevation and intermediate elevation wherein the intermediate elevation is lower than the upper elevation;

tightly connecting an elongated reinforcing member, capable of supporting longitudinal compressive loads, to the tower at said upper elevation;

providing a means for connecting said reinforcing member to the monopole at a height above the ground and below said upper connection, and connecting said reinforcing member to the monopole with said means at a height above the ground and below said upper connection.

27. The method of claim 26 further comprising the step of tightly connecting the elongated reinforcing member to an object below the standoff.

28. The method of claim 26 further comprising the step of anchoring the elongated reinforcing member to the foundation.

29. A method for reinforcing a monopole tower installed on a foundation comprising the steps of:

identifying an upper elevation and intermediate elevation wherein the intermediate elevation is lower than the upper elevation;

tightly connecting an elongated reinforcing member, capable of supporting longitudinal compressive loads, to the tower at said upper elevation;

providing a standoff having an upwardly oriented opening for receiving the reinforcing member; and attaching the standoff to the tower and disposing the reinforcing member through said opening in the standoff at said intermediate elevation so as to provide lateral stability to the reinforcing member and freedom of vertical displacement between the reinforcing member and standoff;

wherein the attaching the standoff step comprises:

providing a fastener for attaching the standoff to the monopole, said fastener comprising;

a body having a head and a shaft; and at least one retractable member connected to the body and movable between a first position in which at least a portion of the member is retracted within the shaft and a second position in which at least a portion of the member is extended outward of the shaft:

inserting fastener into said aligned holes and allowing said retractable member to extended so as to attach the standoff and monopole together in the a space between the member and the head of the fastener body.

* * * * *